United States Patent [19]

Kobayashi et al.

[11] Patent Number: 4,986,248

[45] Date of Patent: Jan. 22, 1991

[54] FUEL SUPPLY SYSTEM FOR INTERNAL COMBUSTION ENGINE USING AN ULTRASONIC ATOMIZER

[75] Inventors: Taiji Kobayashi; Daijiro Hosogai; Kazushi Tsurutani; Noboru Higashimoto; Kakuro Kokubo, all of Ooi, Japan

[73] Assignee: Tonen Corporation, Tokyo, Japan

[21] Appl. No.: 501,988

[22] Filed: Mar. 29, 1990

[30] Foreign Application Priority Data

| | | | |
|---|---|---|---|
| Mar. 30, 1989 | [JP] | Japan | 64-79710 |
| Mar. 31, 1989 | [JP] | Japan | 64-80690 |
| Mar. 31, 1989 | [JP] | Japan | 64-80691 |
| May 15, 1989 | [JP] | Japan | 64-121219 |
| Jun. 29, 1989 | [JP] | Japan | 64-168003 |

[51] Int. Cl.[5] ..... F02M 29/00

[52] U.S. Cl. ..... 123/590; 123/472

[58] Field of Search ..... 123/590, 472; 261/DIG. 48

[56] References Cited

U.S. PATENT DOCUMENTS 4,344,404 8/1982 Child et al. ..... 123/590

4,665,877 5/1987 Manaka et al. ..... 123/472

*Primary Examiner*—E. Rollins Cross

*Attorney, Agent, or Firm*—Armstrong, Nikaido, Marmelstein, Kubovcik & Murray

[57] ABSTRACT

In a fuel supply system for internal combustion engine provided with a fuel injection valve and an ultrasonic atomizer on suction pipe of the engine, the tip of the oscillator member of said ultrasonic atomizer is furnished with an inclined portion and a portion with reduced portion further ahead of said inclined portion. By arranging a fuel supply passage face-to-face to this inclined portion, the shape of the oscillator tip is modified, and it is possible to maintain adequate atomizing angle regardless of the quantity of supply fuel without attaching the fuel on inner wall of inlet pipe, to increase the turndown ratio and to achieve even spraying all over the circumference. Also, it is possible to shorten the starting time when external air temperature is low and to increase the combustion performance and the exhaust property, particularly, in an engine using the fuel difficult to ignite at low temperature such as alcohol, kerosene, etc.

5 Claims, 9 Drawing Sheets

FIG. 11
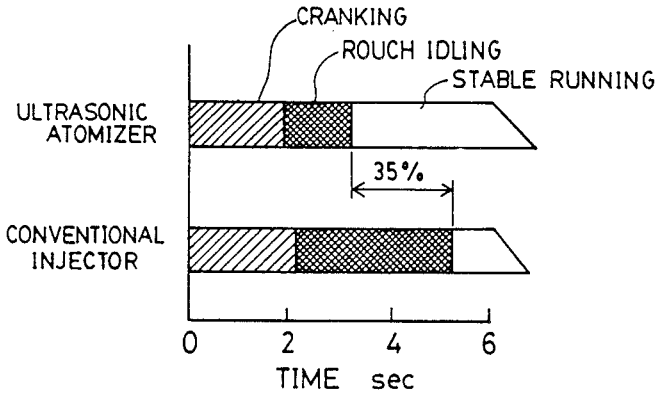
FIG. 12(a)
FIG. 12(b)
FIG. 12(c)
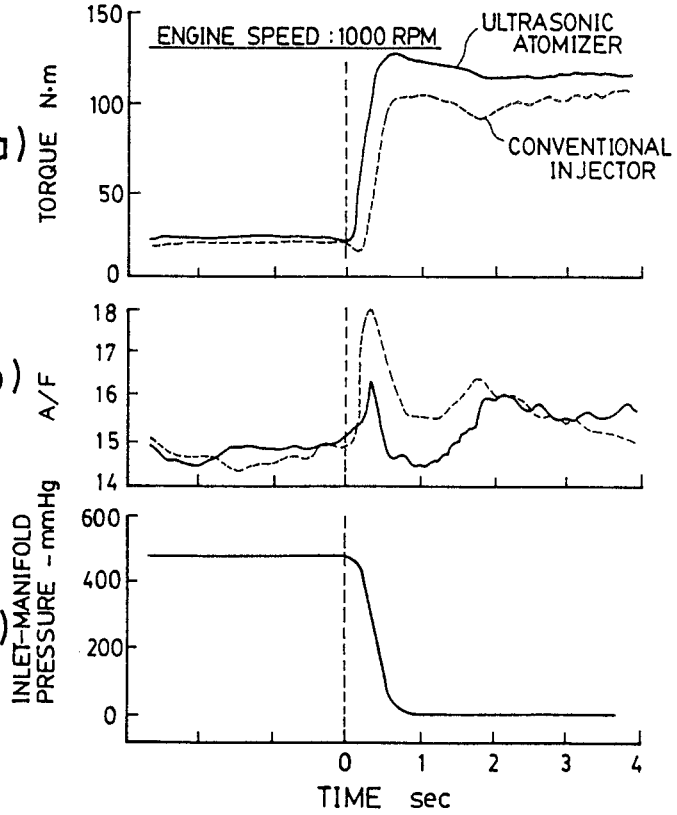

FUEL SUPPLY SYSTEM FOR INTERNAL COMBUSTION ENGINE USING AN ULTRASONIC ATOMIZER

BACKGROUND OF THE INVENTION

The present invention relates to a fuel supply system for internal combustion engine using an ultrasonic atomizer for mixing of fuel and air, applied to a spark ignition type engine, distributing the fuel-air mixture generated by a fuel injection valve to multiple cylinders or to an engine using the fuel difficult to ignite at low temperature such as alcohol, kerosene, etc., and fuel and air are mixed by an ultrasonic atomizer to atomize liquid fuel.

Conventionally, a system to supply fuel-air mixture to engine is known, in which an ultrasonic atomizer is provided on the inlet pipe of internal combustion engine and fuel is atomized and mixed with intake air. For example, in the Japanese Provisional Pat. Publication No. 53-140416, it is proposed to provide a fuel supply system and an annular ultrasonic oscillator in the inlet pipe passage and to promote the mixing of atomized fuel obtained through annular ultrasonic oscillator with the intake air.

In the above conventional system, however, fuel supply system and ultrasonic oscillator are furnished closely to the engine in the inlet pipe passage. Accordingly, air flow is not stable and the intake air and the atomized fuel do not mix well, and fuel is often attached on pipe wall. Particularly, when fuel is attached on pipe wall in a high-powered engine, the transfer speed of fuel-air mixture is decreased at engine starting in low external air temperature and at the pickup time to rapidly accelerate from low speed, and the desired power cannot be obtained.

Also, because annular ultrasonic oscillator is used, fuel is not atomized at the nodal portion of vibration. Thus, the stagnated fuel drips and fuel supply becomes unstable.

On the other hand, an ultrasonic atomizer as shown in FIG. 16 is known as an atomizer to atomize liquid fuel. This consists of a cylinder 101, a nozzle body 102, an oscillator horn 103, and an electro-acoustic transducer 104. A fuel supply passage 105 is formed on the cylinder 101, and an injection hole 106 communicated with the fuel supply passage 105 is formed on the nozzle body 102. A plurality of injection holes 106 are furnished on the circumference of the nozzle body 102 and the fuel injected from the injection holes 106 is supplied to the oscillator horn 103 and is atomized.

However, in the above conventional type ultrasonic atomizer, the atomizing quantity is determined by the quantity of fuel supplied from the injection holes 106. Accordingly, the turndown ratio showing the ratio of maximum atomizing quantity and minimum atomizing quantity cannot be increased. Also, because it is difficult to evenly distribute the fuel into a plurality of injection holes 106 when it is placed to lateral direction, fuel is unevenly atomized. Further, the number of injection holes 106 must be increased in order to distribute the fuel evenly, but such increase is limited. Also, the manufacturing cost may be increased because the injection holes 106 are difficult to fabricate. Because the oscillator horn 103 is designed in horn shape with outer diameter increasing toward the tip, the atomizing angle of the atomized fuel becomes larger when it is installed on engine, and the atomized fuel is attached on inner wall of inlet pipe.

SUMMARY OF THE INVENTION

Therefore, it is an object of the present invention to maintain adequate atomizing angle regardless of the quantity of supply fuel by improving the shape of the oscillator tip of ultrasonic atomizer and also to achieve even spraying all over the circumference with higher turndown ratio.

It is another object of this invention to offer a fuel supply system for internal combustion engine comprising an ultrasonic atomizer, by which it is possible to shorten the starting time when external air temperature is low and to increase combustion performance and exhaust property in a spark ignition type engine, using the fuel difficult to ignite at low temperature such as alcohol, kerosene, etc.

To attain these objects, the fuel supply system for internal combustion engine according to the present invention is furnished with a fuel injection valve and an ultrasonic atomizer on the inlet pipe of the engine, comprising:

an oscillator member, to which ultrasonic vibration is given by ultrasonic vibration generating means, an inner cylinder to be provided on outer periphery of said oscillator member, an outer cylinder engaged with and fixed on said inner cylinder and from a fuel supply passage between itself and said inner cylinder, a fuel supply hole formed on said outer cylinder, a circumferential groove communicated with said fuel supply hole and formed on said inner cylinder, an inclined portion formed at the tip of said oscillator member, and a portion with reduced diameter formed at the tip further ahead of said inclined portion, characterized in that said fuel supply passage is provided at the position face-to-face to said inclined portion.

According to this invention, it is possible to maintain adequate atomizing angle regardless of the quantity of supply fuel by improving the shape of the oscillator member tip of ultrasonic atomizer and to supply the fuel into cylinder without attaching the fuel on inner wall of inlet pipe. Also, because turndown ratio can be increased and even circumferential atomization can be achieved, it is possible to use the ultrasonic atomizer in normal operation with the increased atomizing flow and to simplify the construction because carburetor can be eliminated.

BRIEF DESCRIPTION OF THE DRAWINGS

FIG. 10, 11 and 12 are the diagrams to explain the results of the experiments on the fuel supply system of FIG. 9;

DESCRIPTION OF THE PREFERRED EMBODIMENTS

In the following, the embodiments of this invention will be described in connection with the drawings.

Figure 1:
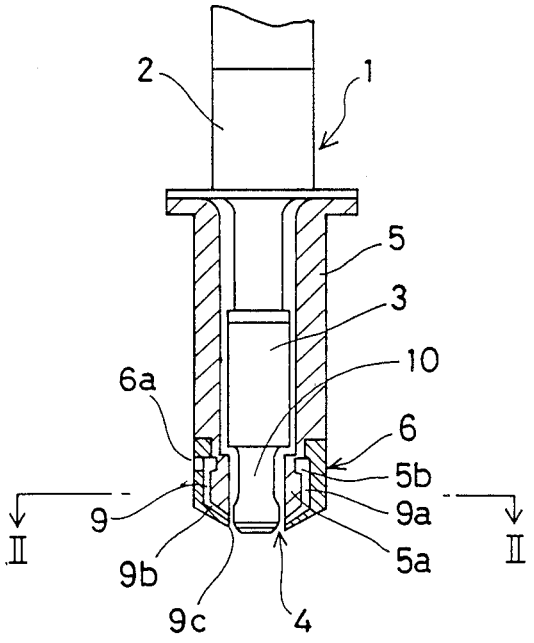
FIG. 1 is a cross-sectional view showing Embodiment 1 of the ultrasonic atomizer according to this invention.
Figure 2:
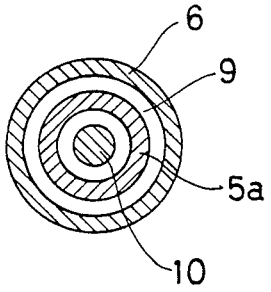
FIG. 2 is a cross-sectional view along the line II—II of FIG. 1.

In FIG. 1 and FIG. 2, the ultrasonic atomizer 1 comprises an oscillator member 10, in which a base 2, a shaft 3 and an atomizing plane 4 are integrated. An inner cylinder 5 is provided on outer periphery of the oscillator member 10. On outer periphery of the tip 5*a* of the inner cylinder 5, an outer cylinder 6 having the inner diameter slightly larger than outer diameter of the tip 5*a* is engaged and fixed, and a fuel supply passage 9 is formed between the tip 5*a* of the inner cylinder 5 and the outer cylinder 6. Also, the tips of inner cylinder 5 and outer cylinder 6 are designed in tapered shape. Accordingly, an annular passage 9*a*, an inclined passage 9*b* and an opening 9*c* are formed between outer periphery of the tip 5*a* of inner cylinder 5 and inner periphery of outer cylinder 6. The inner cylider is provided with a circumferential groove 5*b* at adequate position on its outer periphery, and the outer cylinder 6 is furnished with a liquid fuel supply hole 6*a*, which is communicated with said circumferential groove 5*b* and the passage 9*a*.

To the liquid fuel supply hole 6*a* of the outer cylinder 6, liquid fuel is supplied from fuel injection valve and it is supplied to all over the circumference of the circumferential groove 5*b* of the inner cylinder 5. The liquid fuel thus fed to the circumferential groove 5*b* is sent to the opening 9*c* through the passage 9*a* and the inclined passage 9*b* and reaches the atomizing plane 4. The liquid fuel reached the atomizing plane 4 is atomized by the ultrasonic vibration of the oscillator member 10.

Figure 3:
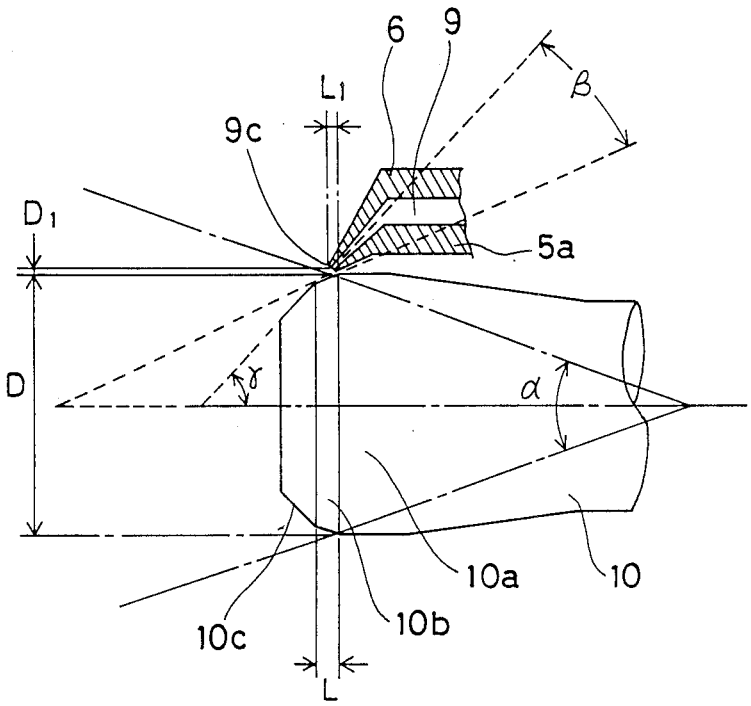
FIG. 3, 4, 5, 6 and 7 are the enlarged partial views of an example showing the shape of atomization plane of oscillator member.

FIG. 3 shows the shape of the tip of the oscillator member 10 and said opening 9*c*. The tip of the oscillator member 10 consists of a portion with enlarged diameter 10*a*, an inclined portion 10*b* and a portion with reduced diameter 10*c*. Said portion with enlarged diameter 10*a* plays a role to increase the atomizing area. Said inclined portion 10*b* is formed in such manner that it maintains a predetermined angle to the axis of the oscillator member 10, and the portion with reduced diameter 10*c* maintains the angle $\gamma$ to the axis of the oscillator member 10. The oscillator member 10 of this invention is characterized in that it is provided with a portion with enlarged diameter 10*a*, whereas it is to maintain the flow of atomized liquid. If it is not necessary to maintain a high flow, there is no need to provide the portion with enlarged diameter 10*a*, and the portion with the same diameter may be used.

An example of the dimension of each component is given below. It is assumed that the diameter D of the portion with enlarged diameter 10*a* of oscillator member is 9 mm, and that the axial length of the inclined portion 10*b* is 0.5 mm. The ratio L/D is 1/10 to 1/30, and more preferably, about 1/18.

The atomizing angle $\alpha$ is set to 30° to 45°. The reason for this is that, when the engine is provided with ultrasonic atomizer, it is important to maintain the atomizing angle in such degree that fuel is not attached on inner wall of suction pipe. However, it is also necessary to widen the angle to some extent in order to increase the mixing effect with the air.

The angle $\beta$ between the tip of fuel supply passage 9 and the inclinded portion 10*b* should be 5–45°, or more preferably, 15°, so that the atomized fuel is not thrown away and is easily attached on the atomizing plane.

Figure 4:
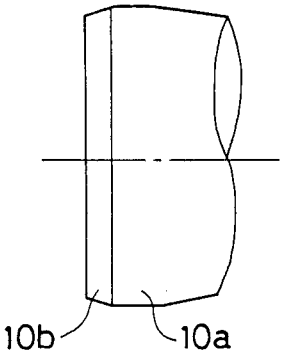
Figure 5:
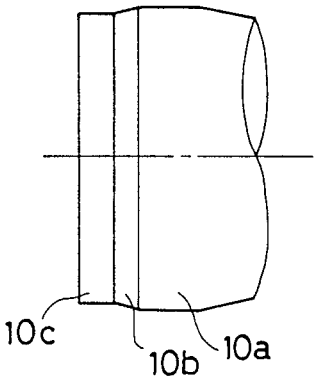

The angle $\gamma$ of the surface of the portion with reduced diameter 10*c* to the axis of the oscillator member 10 is 0°–90° or more preferably, 40°–50°. FIG. 4 shows an example with $\gamma=90°$, and FIG. 5 an example with $\gamma=0°$. The atomizing angle $\alpha$ is widened when the angle $\gamma$ is decreased, and it becomes narrower when the angle $\gamma$ is increased.

The clearance Dl between the opening 9*c* of the fuel supply passage 9 and the portion with enlarged diameter 10*a* of the oscillator member 10 is set to 0.1–0.2 (Dl/D=0.01–0.02). The reason for this is that, if the clearance is smaller than the lower limit, the gap between the tip of fuel supply passage 9 and the oscillator member 10 is too narrow and they may contact each other. If it is larger than the upper limit, the liquid may drip without reaching the surface of the inclined portion 10*b* when liquid flow and pressure are low.

The distance Ll from the opening 9*c* of fuel supply passage 9 to the portion with enlarged diameter 10*a* is 0 to 0.5 mm (Ll/L=0–1). When the distance Ll is decreased and the opening 9*c* is brought closer to the portion with enlarged diameter 10*a*, it is difficult to form liquid membrane. If it is brought closer to the portion with reduced diameter 10*c*, incident angle is turned to minus, and the liquid runs through.

Figure 6:
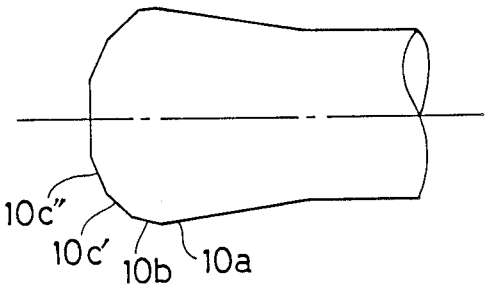
Figure 7:
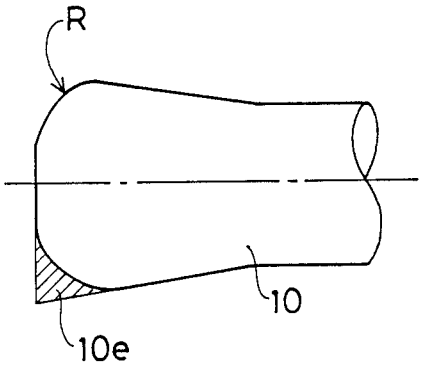

FIG. 6 shows another example of the tip of the oscillator member 10, in which the portion with reduced diameter 10*c* is designed in two steps of 10*c*′ and 10*c*″. FIG. 7 represents still another example of the tip of the oscillator member, in which the tip 10*e* is machined in such manner that the inclined portion and the portion with reduced diameter are formed continuously with the radius of curvature R.

Figure 8:
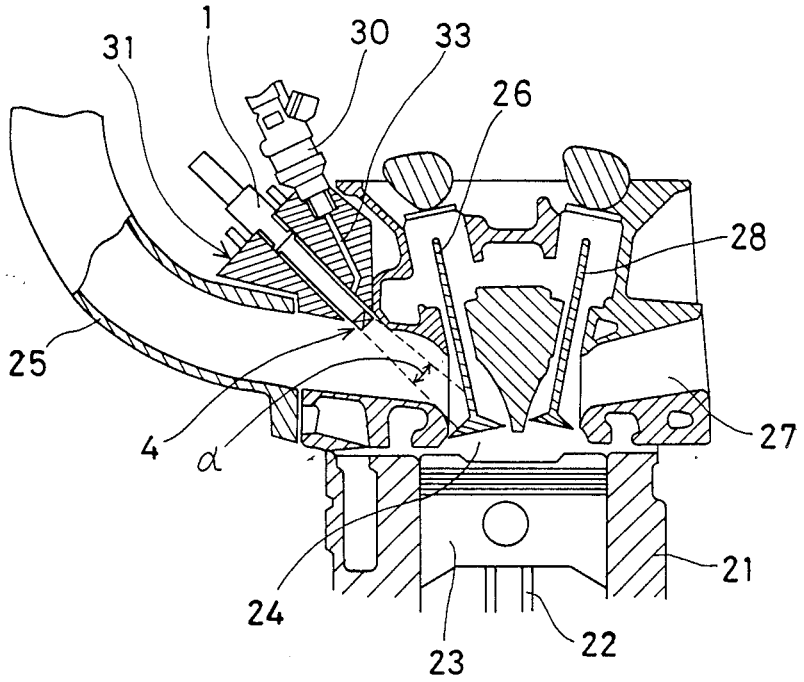
FIG. 8 is a cross-sectional view of Embodiment 1 of the fuel supply system for internal combustion engine using the ultrasonic atomizer of this invention.

FIG. 8 is a cross-sectional view of an embodiment of the fuel supply system 31 for internal combustion engine according to this invention. In this embodiment, a spark ignition type engine with multiple cylinders (MPI: multipoint injection) is provided with the above ultrasonic atomizer.

In this figure, numeral 21 denotes a cylinder, 22 a connecting rod, 23 a piston, 24 a combustion chamber, 25 a inlet pipe, 26 a suction valve, 27 an exhaust pipe, and 28 an exhaust valve. At the predetermined position on the inlet pipe 25, a fuel supply unit 31 comprising an ultrasonic atomizer 1 and a fuel injection valve 30 is furnished, and the atomizing plane 4 at the tip of the ultrasonic atomizer 1 is arranged face-to-face to the suction valve 26. Fuel is supplied from the fuel supply passage 33 of the fuel injection valve 30 to the atomizing plane 4, where fuel is atomized and sprayed into the inlet pipe 25.

Next, description will be given on the operation of the fuel supply system according to this invention.

Liquid fuel reaches the atomizing plane 4 through the circumferential groove 5*b*, the passage 9*a*, the inclined passage 9b, and the opening 9c. In this case, liquid fuel is supplied to all over the whole circumferential surface of the inclined portion 10b from the opening 9c through the circumferential groove 5b. During this process, liquid fuel is formed into the membrane with approximately even thickness, and it reaches the inclined portion 10b. After reaching the inclined portion 10b, liquid fuel is atomized by ultrasonic vibration of the oscillator member 10, and the fuel not atomized enough here flows into the portion with reduced diameter 10c, where all of the fuel is atomized. According to this invention, it is possible to maintain adequate atomizing angle $\alpha$ regardless of the quantity of supply fuel by improving the shape of the oscillator member tip of ultrasonic atomizer and also to supply the fuel into cylinder without attaching the fuel on inner wall of the inlet pipe 25. Also, because the turndown ratio can be increased and even spaying all over the circumference can be achieved, spray flow can be increased and ultrasonic atomizer can be used even during normal operation. The mechanism of the total system can be simplified because carburetor can be eliminated.

Figure 9:
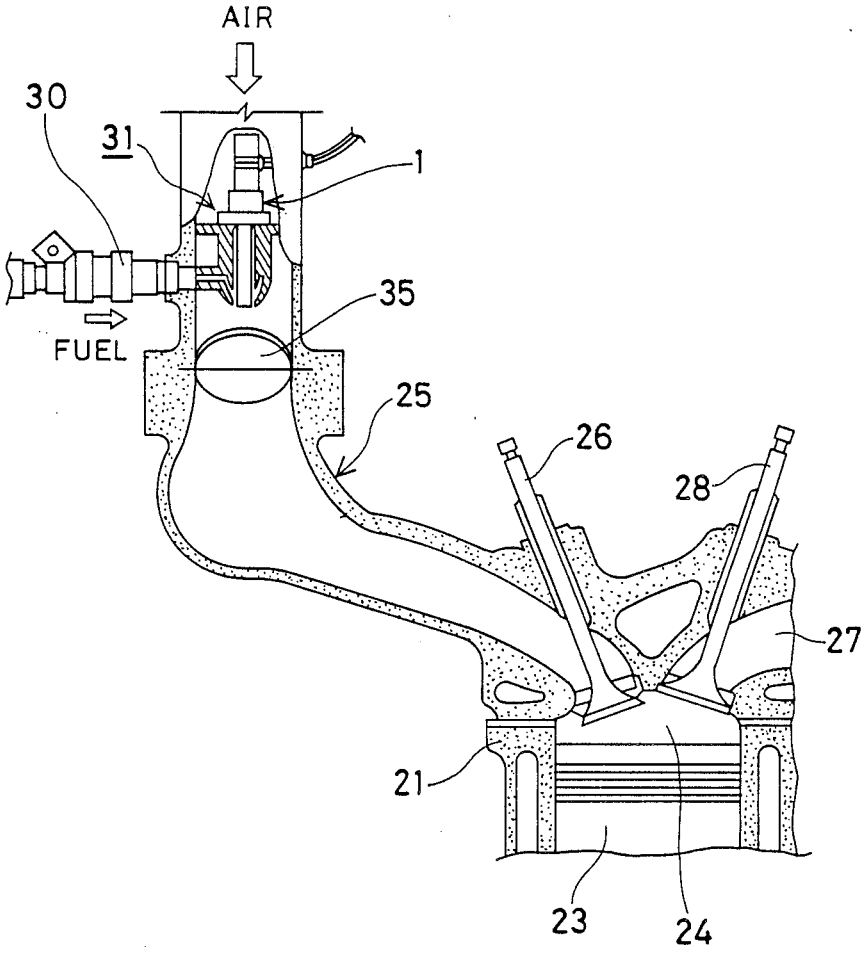
FIG. 9 is a cross-sectional view of another embodiment of the fuel supply system for internal combustion engine using ultrasonic atomizer of this invention.

FIG. 9 is a cross-sectional view of a fuel supply unit according to the present invention, mounted on the intake manifold of a spark ignition type engine of single point injection (SPI) system, in which fuel-air mixture generated from a fuel supply system is distributed to multiple cylinders.

In this figure, the same component has the same number as in the embodiment of FIG. 8.

In this embodiment, the ultrasonic atomizer 1 is provided at the center of the suction pipe 25 upstream of a throttle valve 35, which is interlocked with accelerator pedal. The fuel injection valve 30 is fixed on the side of suction pipe 25 to supply fuel to the ultrasonic atomizer 1.

In this embodiment, the ultrasonic atomizer 1 is furnished upstream of the throttle valve 35. Accordingly, the air flows evenly in the suction pipe during the starting operation when the opening of the throttle valve is small. Thus, the mixing of the atomized fuel is promoted, and the starting time of the engine is shortened.

Figure 10:
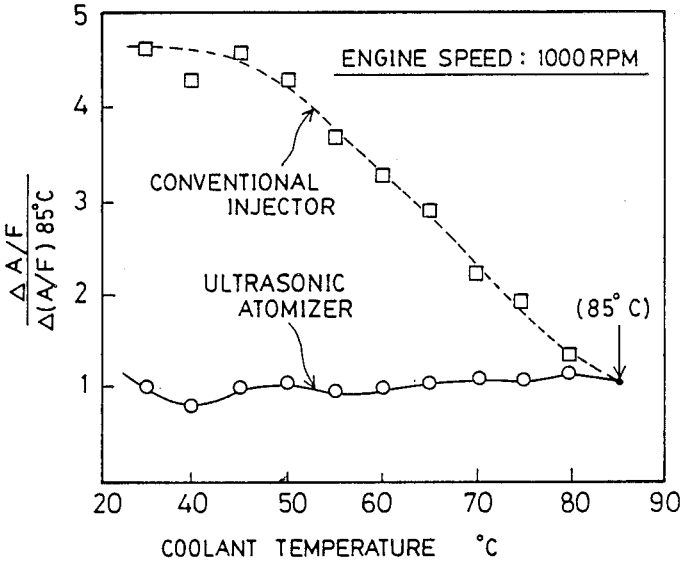

The results of the experiments by the present inventors on this fuel supply system are given in FIGS. 10, 11 and 12.

A single point injection (SPI) engine performance was tested with a 1.8 liter, 4-cylinder commercial engine. The SPI engine fuel injector was just over the throttle body. The fuel was sprayed from a centrally positioned injector and distributed to each cylinder.

A/F Distribution among Cylinders

The fuel distribution to each cylinder was a major concern in the development of a suitable atomizer for the SPI engine. FIG. 10 shows the cylinder-to-cylinder A/F distribution with the rise of engine coolant temperatures. It is generally acknowledged that stable engine operation is not possible when the difference in A/F among cylinders exceeds 2.0. A/F distribution under low temperature conditions tends to deteriorate due to fuel oversupply. The ultrasonic atomizer, however, can maintain a constant fuel distribution through the whole temperature range, as shown in FIG. 10.

Cold Engine Performance

The advantages under cold conditions were also clear in the cold startability tests. Tests were performed under a cold ambient temperature of −10° C. In order to determine cold startability, the tests were carried out without cold starter nozzles. FIG. 11 shows the required cranking time and rough idling time at an ambient temperature of −10° C., the former indicating the time from the beginning of the rotation of the starter motor to the start of complete combustion, and the latter a period of unstable engine vibration. These were measured by an accelerometer on the engine head, which monitors engine vibrations. This figure shows that the ultrasonic atomizer can reduce the cranking time of the conventional injector. Rough idling in engines equipped with ultrasonic atomizers was also significantly lower than in conventionally equipped engines. These advantages in cold engine performance can be explained by the effects of high delivery response and superior atomization.

Transient Response Performance

Transient response tests were also carried out in order to ascertain fuel delivery response. FIG. 12 shows relations among brake torque response, A/F change and vacuum trend. From these results, it can be seen that the conventional injector demonstrates the lean spike and torque drop phenomena after fast throttle ramp. These characteristics impair response in accelerating operations. The ultrasonic atomizer reduces these undesirable phenomena, as shown.

Figure 13:
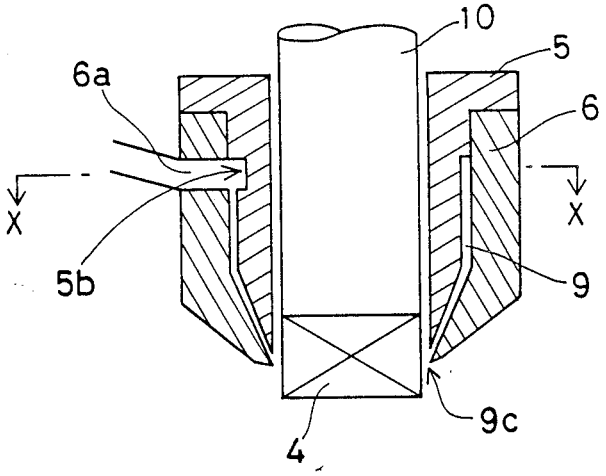
FIG. 13 is a cross-sectional view of another embodiment of ultrasonic atomizer according to this invention.
Figure 14:
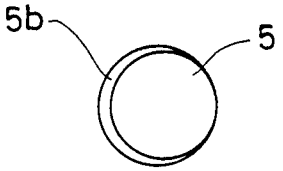
FIG. 14 is a plan view of the circumferential groove along the, line X—X of FIG. 13.

FIGS. 13 and 14 represent another embodiment of the above ultrasonic atomizer 1. In the figure, the same component is referred by the same number as in the embodiment of FIG. 1.

In this embodiment, a circumferential groove 5b is provided on outer periphery of the inner cylinder 5 of ultrasonic atomizer, and it is eccentric to the circumference of the inner cylinder 5 as shown in FIG. 14. The depth of the circumferential groove 5b is maximized toward the fuel supply hole 6a, and the depth of the groove 5b is decreased toward the direction opposite from the fuel supply hole 6a. Accordingly, even when the liquid is supplied by pressurizing, liquid is not supplied excessively to the direction opposite from fuel supply. Thus, the liquid supplied from the nozzle 9c to the atomizing plane 4 of the oscillator member 10 is distributed evenly all over the circumference. Therefore, it is possible to atomize the fuel evenly all over the circumference of the atomizing plane 4 of the oscillator member 10, and the fuel can be sprayed evenly all over the circumference. By changing the depth of the circumferential groove 5b, it is possible to provide even spraying and to change the density of spray over the circumference for each application purpose.

Next, description will be given on another embodiment of this invention in connection with FIG. 15.

Figure 15A:
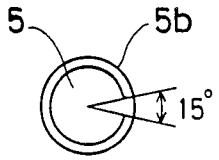
FIGS. 15(*a*)–15(*c*) represent other embodiments of ultrasonic atomizer of this invention, showing plan views of the circumferential groove along the line X—X of FIG. 13.
Figure 15B:
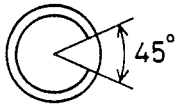
Figure 15C:
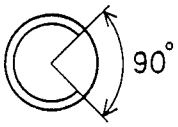
Figure 16:
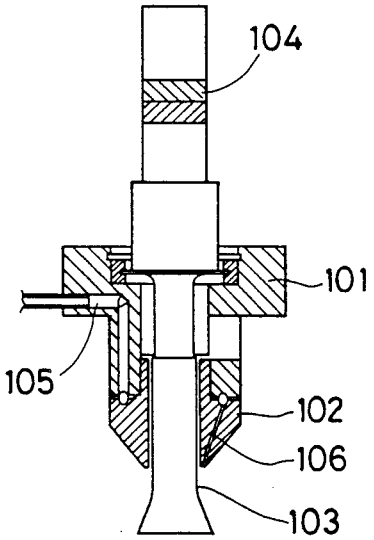
FIG. 16 is a cross-sectional view showing a conventional type ultrasonic atomizer.

In this embodiment, the circumferential groove 5b is provided on outer periphery of the inner cylinder 5 of ultrasonic atomizer at the angle of 15, 45 or 90 degrees respectively as shown in FIGS. 15 (*a*) to (*c*), leaving the circumference intact at some angle. Because the circumferential groove 5b is not furnished on the opposite side of the fuel supply hole 6a, the liquid is not distributed too much on the opposite side of the liquid supply hole even when the liquid is supplied by pressurizing.

In the embodiments of FIGS. 8 to 15, the shape of the oscillator member is preferably as given in FIGS. 3 to 7. It is also effective to adopt a horn-like shape, in which outer diameter is increased toward the tip of the oscillator member.

What is claimed is:

1. A fuel supply system for internal combustion engine furnished with a fuel injection valve and an ultrasonic atomizer on the suction pipe of the engine, said ultrasonic atomizer comprising:

an oscillator member, to which ultrasonic vibration is given by an ultrasonic vibration generating means, an inner cylinder provided on outer periphery of said oscillator member, an outer cylinder engaged with and fixed on said inner cylinder and forming a fuel supply passage between itself and said inner cylinder, a fuel supply hole formed on said outer cylinder, and a circumferential groove communicated with said fuel supply hole and formed on said inner cylinder, further comprising an inclined portion formed at the tip of said oscillator member, and a portion with reduced diameter formed at the tip ahead of said inclined portion, characterized in that said fuel supply passage is arranged face-to-face to said inclined portion.

2. A fuel supply system as set forth in claim 1, wherein said ultrasonic atomizer is installed at the center of suction pipe upstream of the throttle valve.

3. A fuel supply system as set forth in claim 1, wherein said fuel consists of alcohol or kerosene.

4. A fuel supply system as set forth in claim 1, wherein said circumferential groove is provided on outer periphery of said inner cylinder and is eccentric to the circumference of said inner cylinder.

5. A fuel supply system as set forth in claim 1, wherein said circumferential groove is provided on outer periphery of said inner cylinder, leaving a portion of the circumference intact at an angle.

* * * * *